US006052866A

United States Patent [19]

Tuvin et al.

[11] Patent Number: 6,052,866

[45] Date of Patent: Apr. 25, 2000

[54] UPHOLSTERY NOZZLE

[75] Inventors: Lars Tuvin, Knivsta; Göran Sjöberg, Kungsängen, both of Sweden

[73] Assignee: Aktiebolaget Electrolux, Stockholm, Sweden

[21] Appl. No.: 09/065,368

[22] Filed: Apr. 23, 1998

[30] Foreign Application Priority Data

Jun. 13, 1997 [SE] Sweden ..... 9702261

[51] Int. Cl.[7] ..... A47L 9/02

[52] U.S. Cl. ..... 15/416; 15/421

[58] Field of Search ..... 15/415.1, 416, 15/420, 421

[56] References Cited

U.S. PATENT DOCUMENTS

| | | | |
|---|---|---|---|
| 1,819,131 | 8/1931 | Spanel | 15/416 |
| 4,454,627 | 6/1984 | Simm et al. | 15/416 |
| 4,694,529 | 9/1987 | Choiniere | 15/415.1 |
| 4,723,338 | 2/1988 | Otsubo | 15/416 |
| 4,776,059 | 10/1988 | Worwag | 15/416 |
| 4,879,784 | 11/1989 | Shero | 15/416 |

FOREIGN PATENT DOCUMENTS

| | | |
|---|---|---|
| A2 0 194 107 | 9/1986 | European Pat. Off. . |
| 64339 | 4/1926 | Sweden . |
| 115825 | 2/1946 | Sweden . |

*Primary Examiner*—Robert J. Warden, Sr.
*Assistant Examiner*—Andrew Aldag
*Attorney, Agent, or Firm*—Pearne, Gordon, McCoy & Granger LLP

[57] ABSTRACT

An upholstery nozzle for a vacuum cleaner including an inlet part, an outlet part (12) and an intermediate channel (13) extending between the inlet and outlet parts. The inlet part includes an elongated nozzle opening (11*a*) and a spot suction nozzle 11(*b*). The spot suction nozzle (11*b*) is arranged close to the nozzle opening (11*a*) and is in direct communication with the intermediate channel (13).

12 Claims, 2 Drawing Sheets

UPHOLSTERY NOZZLE

BACKGROUND OF THE INVENTION

The present invention generally relates to an upholstery nozzle for a vacuum cleaner and, more specifically, to an upholstery nozzle having an inlet part and an outlet part for air and an intermediate channel extending therebetween, and wherein the inlet part comprises an elongated nozzle opening.

Different types of nozzles for cleaning upholstery are known in the art. When cleaning sofas and other types of upholstery, a fixed nozzle having an elongated plane nozzle opening that continues into a central outlet opening is commonly used. The length of the nozzle opening is usually between about 5 to 25 cm, which means that the nozzle is small and hence suitable to use for upholstery cleaning. A disadvantage with such nozzles is that, despite their size, it is difficult to reach down between the cushions, around the cushion bottoms, and in narrow openings and corners.

In order to solve this problem, alternative upholstery nozzles have been developed. For example, EP 277628 discloses a nozzle which, in addition to the elongated nozzle opening, has a turnable pipe through which air is drawn when the pipe is folded out. The pipe forms a spot suction nozzle which makes it possible to effectively clean hard to reach areas, such as those mentioned above. In order to further increase dust removal, the lastmentioned nozzle includes a brush roll which is driven by an electric motor in the nozzle.

Unfortunately, the design of the lastmentioned nozzle is complicated and manual operations are needed to shift between the different cleaning functions. Accordingly, there exists a need in the art for a simple upholstery nozzle which can be used for different purposes without manual conversion operations.

SUMMARY OF THE INVENTION

The present invention is directed toward an upholstery nozzle which removes or minimizes the disadvantages present in the aforementioned upholstery nozzles. The present invention is further directed toward a nozzle which is uncomplicated and which can be used for the two functions without being shifted manually.

In accordance with the present invention, an upholstery nozzle includes an inlet part, an outlet part, and an intermediate channel which extends between the inlet and outlet parts. The inlet part includes an elongated nozzle opening and a spot suction nozzle. The spot suction nozzle is arranged in series with the nozzle opening and the intermediate channel.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
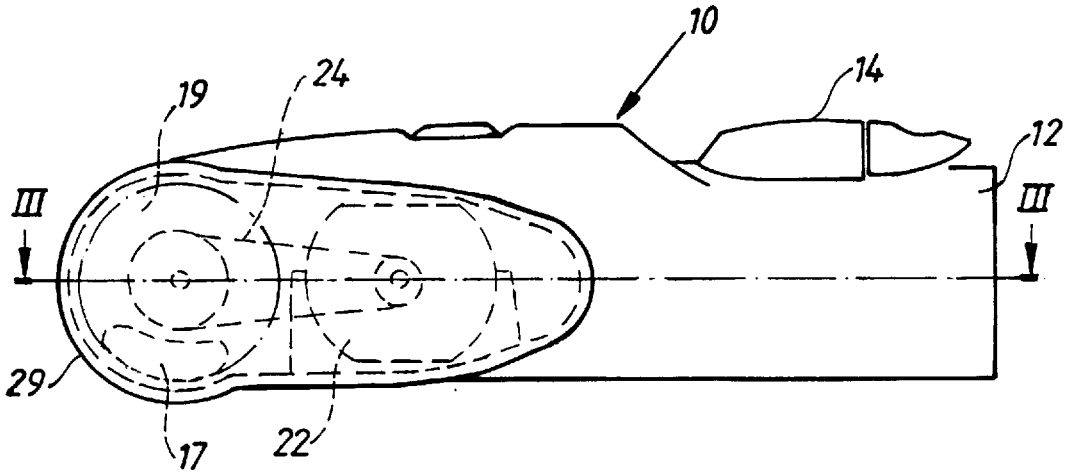
FIG. 1 is a side view of a nozzle according to the present invention.
Figure 2:
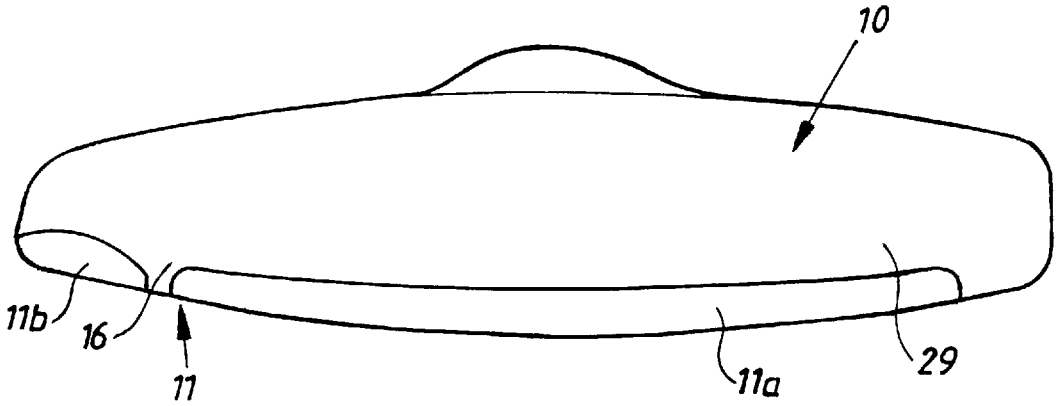
FIG. 2 is a front view of the front part of the nozzle shown in FIG. 1.
Figure 3:
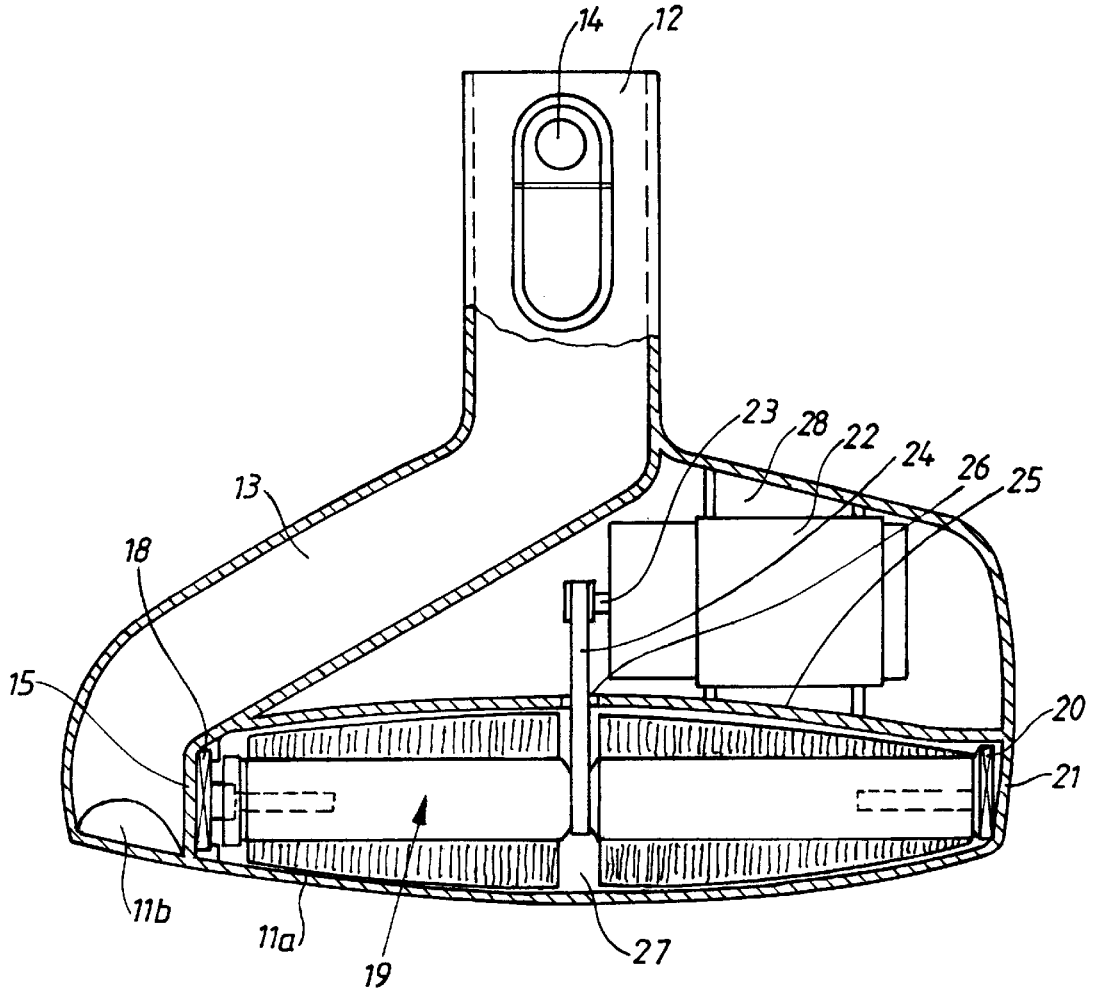
FIG. 3 is a section view of the nozzle as seen along line III—III in FIG. 1.

With reference to the drawing figures, a nozzle according to the present invention includes a housing 10 with an inlet part 11, an outlet part 12, and an intermediate channel 13. The outlet part 12 is shaped as a tube to which a tube handle of a vacuum cleaner (not shown) can be connected and locked by means of a locking means 14. The inlet part 11 comprises an elongated nozzle opening 11*a* and a spot suction nozzle 11*b*.

The nozzle opening 11*a* and the spot suction nozzle 11*b* are separated from each other by an intermediate wall 15 which, at its lower part, continues into a wall part 16 extending mainly perpendicularly to the intermediate wall 15. The intermediate wall 15 is provided with an opening 17 between the spot suction nozzle 11*b* and the nozzle opening 11*a* and a bearing arrangement 18 for one end of a brush roll 19 arranged in the housing 10 near the nozzle opening 11*a*. The other end of the brush roll is supported in a bearing arrangement 20 provided on one side wall 21 of the nozzle.

The housing 10 also encloses an electric motor 22 having a shaft 23 which supports a drive pulley for a drive belt 24 arranged to surround and rotatably drive the brush roll 19. The electric motor 22 can, by means of electric conductors (not shown), be connected to the electric circuit of the vacuum cleaner. The electric motor 22 is separated from the brush roll by means of a wall 25 with openings 26 for the drive belt 24 thereby forming a pocket 27 and a chamber 28 for the electric motor 22. The pocket 27 communicates with the channel 13 via the opening 17.

The spot suction nozzle 11*b* continues directly into the channel 13 and is placed at one edge or side of the nozzle. The nozzle opening 11*a* has a length which is between 5 and 25 cm. The spot suction nozzle 11*b* has an inlet opening with an area which is much less than the area of the nozzle opening 11*a*, as illustrated. Thus, the spot suction nozzle 11*b* is, with respect to air flow, placed between and in series with the channel 13 and the nozzle opening 11*a* such that when the inlet opening of the spot suction nozzle 11*b* is blocked, the air flows with high velocity through the opening 17 into the spot suction nozzle. The nozzle opening 11*a* and the inlet opening of the spot suction nozzle 11*b* are placed at the downwardly curved front wall part 29 of the housing 10, as illustrated.

The nozzle is used and operates in the following manner. When the nozzle has been connected to the tube handle of the vacuum cleaner the curved wall part 29 is moved on a textile surface of a sofa or other soft material. The electric motor 22 may be started to rotate the brush roll 19 in order to increase removal of dust from the surface. Alternatively, the nozzle can be used without the brush roll with satisfactory results. Dust particles and air will be drawn through the nozzle opening 11*a* and the inlet opening of the spot suction nozzle 11*b* to the channel 13 and further through the outlet part 12.

In order to reach deeper into furniture near cushion bottoms, narrow openings and corners, the nozzle is tilted such that the spot suction nozzle 11*b* penetrates into the cleaning area whereas the major part of the nozzle opening 11*a* is placed above the soft surface. This means that air will be drawn mainly through the nozzle opening 11*a* and flow through the opening 17 in the wall 15 into the spot suction nozzle 11*b* close to the surface of the soft material exposed through the inlet opening of the spot suction nozzle 11*b* and further into the channel 13. Since almost all air which is taken in from the nozzle opening 11*a* flows with high velocity above the exposed surface of the soft material, dust and dirt particles are effectively removed from the surface.

While the preferred embodiment of the present invention is shown and described herein, it is to be understood that the same is not so limited but shall cover and include any and all modifications thereof which fall within the purview of the invention. For example, it is noted that it is not necessary for the intermediate wall 15 to extend all the way down to the plane of the nozzle opening. Instead the nozzle opening and the spot suction nozzle could form a common continuous inlet opening.

What is claimed is:

1. An upholstery nozzle for a vacuum cleaner, comprising an inlet part (11) and an outlet part (12) for air and an intermediate channel (13) extending between said inlet and outlet parts, said inlet part comprising an elongated nozzle opening (11*a*), wherein the inlet part also comprises a spot suction nozzle (11*b*) and the opening of the spot suction nozzle (11*b*) is separated from the nozzle opening (11*a*) by means of an intermediate wall (15), said intermediate wall having an opening (17) for air flowing from the nozzle opening (11*a*) to the channel (13) via the spot suction nozzle (11*b*).

2. An upholstery nozzle according to claim 1, wherein the area of the inlet opening of the spot suction nozzle (11*b*) is less than the inlet area of the nozzle opening.

3. An upholstery nozzle according to claim 1, wherein the inlet opening of the spot suction nozzle (11*b*) is arranged near one end of the nozzle opening (11*a*).

4. An upholstery nozzle according to claim 1, wherein the intermediate wall (15) has a lower surface (16) which is disposed generally in the same plane as the nozzle opening (11*a*).

5. An upholstery nozzle according to claim 1, further comprising a brush roll (19) and a drive motor (22) for said brush roll, said brush roll having an axis which is generally parallel to a length direction of the nozzle opening (11*a*).

6. An upholstery nozzle according to claim 5, wherein the area of the inlet opening of the spot suction nozzle (11*b*) is less than the inlet area of the nozzle opening.

7. An upholstery nozzle according to claim 5, wherein the inlet opening of the spot suction nozzle (11*b*) is arranged near one end of the nozzle opening (11*a*).

8. An upholstery nozzle according to claim 5, wherein the nozzle opening (11*a*) has a length which is between about 5 and 25 cm.

9. An upholstery nozzle according to claim 5, wherein the spot suction nozzle (11*b*) is designed such that air flow velocity from the nozzle opening (11*a*) to the spot suction nozzle (11*b*) increases when the spot suction nozzle is blocked.

10. An upholstery nozzle according to claim 1, wherein the nozzle opening (11*a*) has a length which is between about 5 and 25 cm.

11. An upholstery nozzle according to claim 1, wherein the spot suction nozzle (11*b*) is designed such that air flow velocity from the nozzle opening (11*a*) to the spot suction nozzle (11*b*) increases when the spot suction nozzle is blocked.

12. An upholstery nozzle for a vacuum cleaner, comprising an inlet part (11) and an outlet part (12) for air and an intermediate channel (13) extending between said inlet and outlet parts, said inlet part comprising an elongated nozzle opening (11*a*), said nozzle further comprising a brush roll (19) and a drive motor (22) for said brush roll, said brush roll having an axis which is generally parallel to a length direction of the nozzle opening (11*a*), wherein the inlet part also comprises a spot suction nozzle (11*b*) and the opening of the spot suction nozzle (11*b*) is separated from the nozzle opening (11*a*) by means of an intermediate wall (15), said intermediate wall having an opening (17) for air flowing from the nozzle opening (11*a*) to the channel (13) via the spot suction nozzle (11*b*), wherein said intermediate wall has a lower surface (16) which is disposed generally in the same plane as the nozzle opening.

* * * * *